US012758845B2

(12) United States Patent
Rigoli

(10) Patent No.: US 12,758,845 B2
(45) Date of Patent: Oct. 13, 2026

(54) ADJUSTABLE BRACKET MECHANISM ATTACHABLE TO A SPORTS GOAL PRACTICE BACKSTOP SYSTEM

(71) Applicant: Michael Rigoli, East Falmouth, MA (US)

(72) Inventor: Michael Rigoli, East Falmouth, MA (US)

( * ) Notice: Subject to any disclaimer, the term of this patent is extended or adjusted under 35 U.S.C. 154(b) by 280 days.

(21) Appl. No.: 18/208,922

(22) Filed: Jun. 13, 2023

(65) Prior Publication Data

US 2023/0398425 A1 Dec. 14, 2023

Related U.S. Application Data

(60) Provisional application No. 63/351,588, filed on Jun. 13, 2022.

(51) Int. Cl.

| | |
|---|---|
| ***A63B 67/00*** | (2006.01) |
| ***A63B 63/00*** | (2006.01) |
| ***A63B 69/00*** | (2006.01) |
| ***A63B 71/02*** | (2006.01) |

(52) U.S. Cl.
CPC ..... *A63B 71/022* (2013.01); *A63B 69/0024* (2013.01); *A63B 2225/09* (2013.01)

(58) Field of Classification Search
CPC ..... A63B 71/022; A63B 69/0024
USPC ..... 473/421
See application file for complete search history.

(56) References Cited

U.S. PATENT DOCUMENTS

| | | | | |
|---|---|---|---|---|
| 7,963,865 | B2 * | 6/2011 | Rigoli | A63B 71/022 473/478 |
| 8,100,784 | B2 * | 1/2012 | Conforti | A63B 71/022 473/478 |
| 10,195,508 | B2 * | 2/2019 | Rigoli | A63B 69/0024 473/446 |
| 11,857,856 | B2 * | 1/2024 | Kapsalis | A63B 63/004 473/446 |

* cited by examiner

*Primary Examiner* — Mitra Aryanpour
(74) *Attorney, Agent, or Firm* — Bay State IP, LLC

(57) ABSTRACT

Certain aspects of the present disclosure are directed to a universal and adjustable goal practice backstop system for hockey goals and other similar types of sports goals which comprises an attachable bracket system that may telescope to fit all sizes and widths of a hockey goal and other similar types of sports goals via a number of clamp mechanisms. The backstop system provides improved side coverage of a practice area with a forward lean design enabled by a pair of pivot bracket assemblies which comprise a pair of net pole sockets and a pair of universal pivot bracket mounting bases. It is durable, lightweight, versatile yet can be transported and stored easily in a fold-away position without the need to utilize any tools.

9 Claims, 11 Drawing Sheets

ADJUSTABLE BRACKET MECHANISM ATTACHABLE TO A SPORTS GOAL PRACTICE BACKSTOP SYSTEM

CROSS REFERENCE TO RELATED APPLICATION

This application claims the benefit of and takes priority from U.S. Provisional Patent Application Ser. No. 63/351,588 filed on Jun. 13, 2022, the contents of which are herein incorporated by reference.

FIELD OF THE INVENTION

The present invention relates generally to sporting goods, namely an adjustable and attachable bracket mechanism for sports goal practice backstop systems. More specifically, the invention relates to an adjustable bracket that can telescope to fit all frame sizes and widths of a hockey goal.

BACKGROUND OF THE INVENTION

Many sports like hockey, lacrosse, golf, and soccer require a player to participate in the game by scoring goals, which involves the utilization of some type of ball or similar object in order to accomplish the outcome of the game. A player must successfully score a goal by getting the ball or puck into a goal. Goal backstops are often used during practice to aid in retaining the ball or playing within the confines of the playing field or practice area.

Many players spend countless hours practicing shooting pucks and balls into locations that tend to be more difficult for the goalie to protect. These target shooting practice usually occurs within a predefined practice area with the help from a sports goal backstop system to retain a puck or a ball. Any interrupted practice situations can become frustrating, discouraging, and cause players, especially younger players to quickly lose interest and/or practice their shooting drills less. Any time spent finding and retrieving wild pucks and balls takes time away from actual practice and ultimately is wasted time for individuals trying to perfect their shooting.

In addition, depending on the location of the field, rink, or practice area, and the inherent proximity to wooded areas, houses, and/or automobiles, when shots are missed, the ball may be lost and damage may additionally be incurred by surrounding houses, automobiles, and even people and animals. For example, a hockey puck can cost about $3.00 per puck, which can place additional financial burden on players on a regular basis and renders practicing intricate shots prohibitive from a budgetary standpoint. Furthermore, an innocent bystander or personal property may withstand injury or damage from loose, wild pucks, taking chances will inherently be discouraged.

As a result, players rely on various types of sports goal backstops to retain a ball, to prevent it from travelling beyond the goal or the practice area, and to keep the ball in a general practice area. Further, backstops are used in retrieval of shots that miss the desired mark.

However, some prior art backstop apparatuses require extensive setup and maintenance, including the possibility of using tools to assemble and drill holes in the goal in order to install the apparatus. This type of design is likely quasi permanent due to the difficulty in setting up and handling the components of the apparatuses.

Further, many prior art utilizes a "fence-like" design that simply comprises a long metal tubular framed net installed to the ground behind the goal using stabilizing cables at each end. This type of design is flimsy and does not withhold impact from pucks, balls, or strong wind, which substantially increases the likelihood of being damaged during practice. More importantly, they do not offer backstop support for "bounce shots" as described above.

Additionally, some prior art backstops adopt a "cage" type design, similar to a golf practice apparatus, which is intended to fully encase the entire goal. However, these backstops possess very limited backstop protection from side to side and above the goal standpoints. The cage-like design is extremely restrictive when trying to practice shooting on a net at an angle.

In other instances, many prior art backstop systems cannot be easily stored away at the end of practice and take up massive amount of storage space. Others are statically attached to a practice goal, which must be transported and set up at the field for practice, and then transported from the field. The process is not only cumbersome, but also extremely time consuming.

SUMMARY OF THE INVENTION

The present invention, as illustrated herein, is clearly not anticipated, rendered obvious, or even present in any of the prior art mechanisms, either alone or in any combination thereof.

Provided in one aspect is a smart backstop system mounted on a hockey goal which comprises a universally attachable and adjustable bracket mechanism that may telescope to fit all frame sizes and widths of a hockey goal and other similar types of sports goals. The backstop system provides improved side coverage of a practice area with a forward lean design. It is durable, lightweight, versatile yet can be transported and stored easily without the need to utilize any tools.

Accordingly, certain aspects are directed to an universal sports goal practice backstop system comprising a telescoping bracket mechanism that can be mounted securely on a hockey goal of all sizes and widths and other similar sports goals via a plurality of bolt clamping apparatuses, wherein the bracket further comprises a frame with an inner and outer telescoping tube assemblies and lock/unlock buttons for length adjustability.

In a preferred embodiment, the system is easy to mount and dismount from a hockey goal by hand via a plurality of bracket mechanisms and pivot bracket mechanisms. It is lightweight, compact, and durable. It may fit but is not limited to a configuration such as a 60 inch×10 inch×8 inch box or in a travel bag or other duffle bag mechanism. Once the setup is completed, it requires only one person to deploy and stow the present system.

In one embodiment, a sports goal practice backstop system is configured to removably attach to a sports goal comprising a telescoping bracket frame. The telescoping bracket frame is removably mounted to a sports goal and is comprised of at least two bolt clamping mechanisms. Each of the bolt clamping mechanisms comprise a clamp configured to removably attach to the sports goal, a clamp knob configured to prevent the sports goal practice backstop system from rotating during use, and a bracket configured to center the telescoping bracket frame. The sports goal practice backstop system further comprises a pair of pivot bracket assemblies located at each end of the telescoping bracket frame. Each pivot bracket assembly further comprises a corresponding net pole socket, and a first and second telescoping net pole. Each net pole is received in a corresponding net pole socket on the pivot bracket assembly. The first and second telescoping net poles extend outwardly from each end of the telescoping bracket frame.

In one embodiment, the backstop system does not require any drilling of holes in a goal and the utilization of tools to assemble and mount the system on the goal because the frame has a plurality of self-centering "V" brackets and J-bolt clamp knobs to accommodate and securely mount the backstop system on goals with different diameters.

In one embodiment, the backstop system further comprises a pair of universal pivot bracket assemblies attached to the right and the left end of the system, wherein the "X" shaped configuration on the back side of the mounting base of the pivot bracket assemblies allows the mounting bases to be attached to either the left or the right end of the inner tube assembly. Additionally, each pivot bracket assembly further includes a net pole socket, wherein the exterior of the sockets has reinforcement rings to improve hood strength around the net pole sockets to help prevent breaking under pole lateral stress; and wherein a pivot bracket polymer insert is located inside each net pole socket to absorb energy and minimize stress on the socket to prevent fatigue.

In one embodiment, each pivot bracket assembly further comprises a pair of net retainer holes for the straps that retains a net assembly to the pivot bracket assembly.

In yet another embodiment, the present system provides a lift to unlock design for the pivot bracket sockets which allows a user to lift to unlock and rotate the pivot bracket assemblies into a forward lean position from a fold-away position. A user may lift to unlock the backstop system from the fold-away position by pulling the universal pivot brackets to deploy the net assembly. This procedure repeats in reverse to stow away the backstop.

Additionally, the backstop system provides extended coverage around the area of the frame and allows the player to stow the backstop netting behind the goal in a non-functional area so that the goal can be practiced without the interference of a backstop. The benefit of this design is that the player can easily deploy the backstop for practice and then quickly stow it away for game-like shooting and scrimmages.

In yet another embodiment, the present system provides a backstop design that offers shot protection from all angles including the top due to its innovative forward angular design on all three sides—top, left, and right. The top angle design allows the player to take bounce shots with a high probability of stopping it in the event that it misses the intended target. The corner and side gap shorts are supported by the forward angular side design. If the player wishes to practice sharp angle shots from either side, the player simply folds the shooting side net wing back behind the goal, leaving the rest of the system intact and functioning, thus allowing the player to shoot without interference from the backstop on that given side.

The present invention provides a universally adjustable and attachable backstop system for hockey goals and other similar sports goals with a telescoping bracket mechanism and a number of pivot bracket mounting mechanisms that are designed to fit all sizes and widths of a hockey goal. The backstop system provides extended and adjustable side coverage of a practice area with its forward lean design. It may facilitate in the prevention of a wayward shot from traveling beyond the goal and thus eliminate the need for the players to chase the ball or puck. This allows for more efficient practice time. Further, the backstop system is durable, lightweight, versatile yet can be transported and stored easily without the need to utilize any tools.

DETAILED DESCRIPTION OF THE SEVERAL EMBODIMENTS

Figure 1:
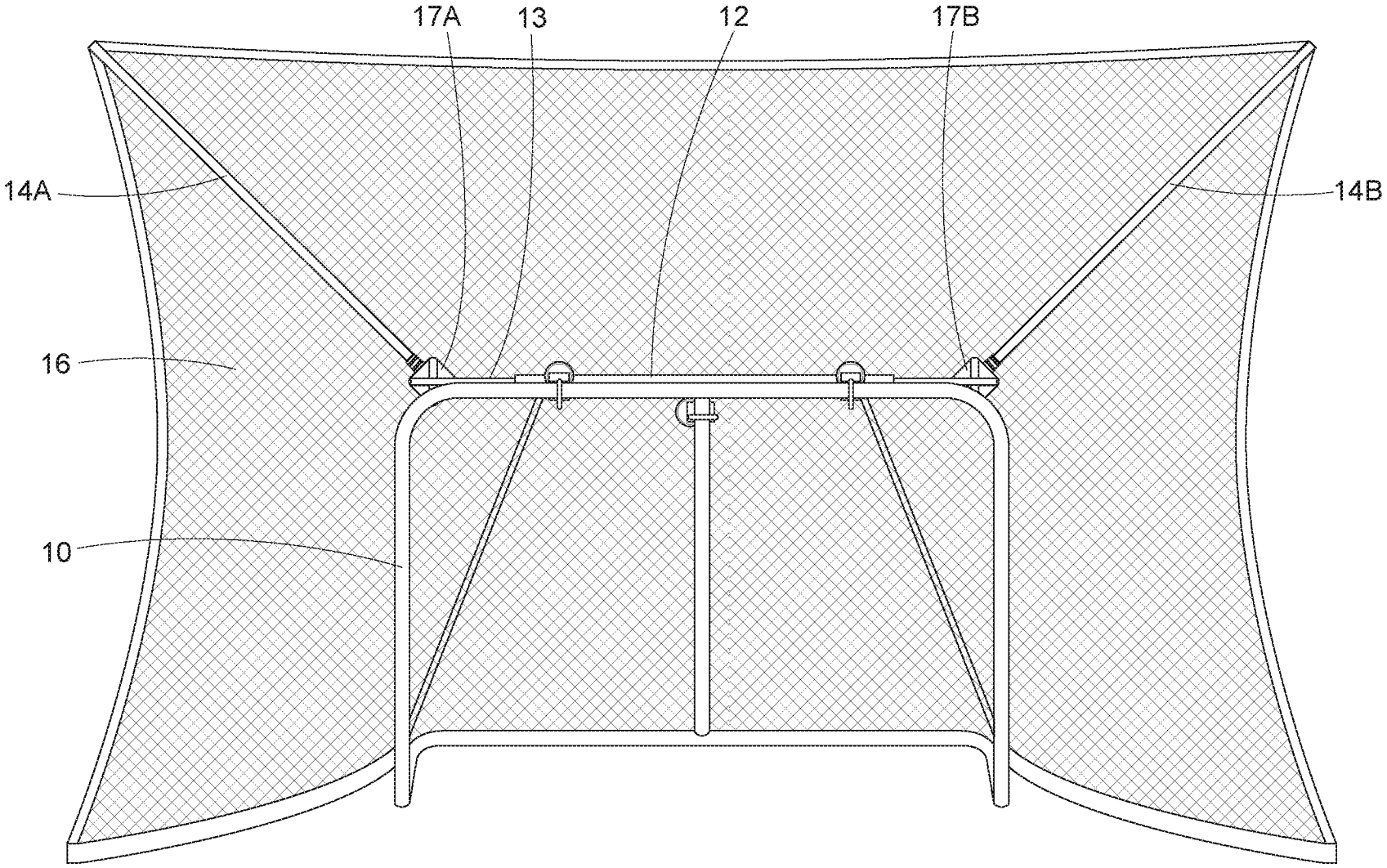
FIG. 1 illustrates the front view of the fully assembled backstop system with the attachable and adjustable bracket mechanism mounted on an existing hockey goal at its forward lean position with backstop netting.

Reference will now be made to non-limiting embodiments, examples of which are illustrated in the Figures. FIG. 1 shows the fully assembled adjustable and attachable goal practice backstop system 12 mounted on an existing hockey goal 10 at a forward lean position with a backstop netting 16. The backstop system 12 comprises an adjustable bracket frame 13 with a first net pole 14*a* and a second net pole 14*b* removably attached to a first pivot bracket assembly 17*a* and a second pivot bracket assembly 17*b* respectively to accommodate the backstop netting 16. The adjustable bracket frame 13 may telescope to fit all sizes and widths of any existing hockey goals or other similar types of sports goals. The forward lean design offers shot protection from all angles including the top due to its innovative forward angular design on all three sides—top, left, and right.

Figure 2:
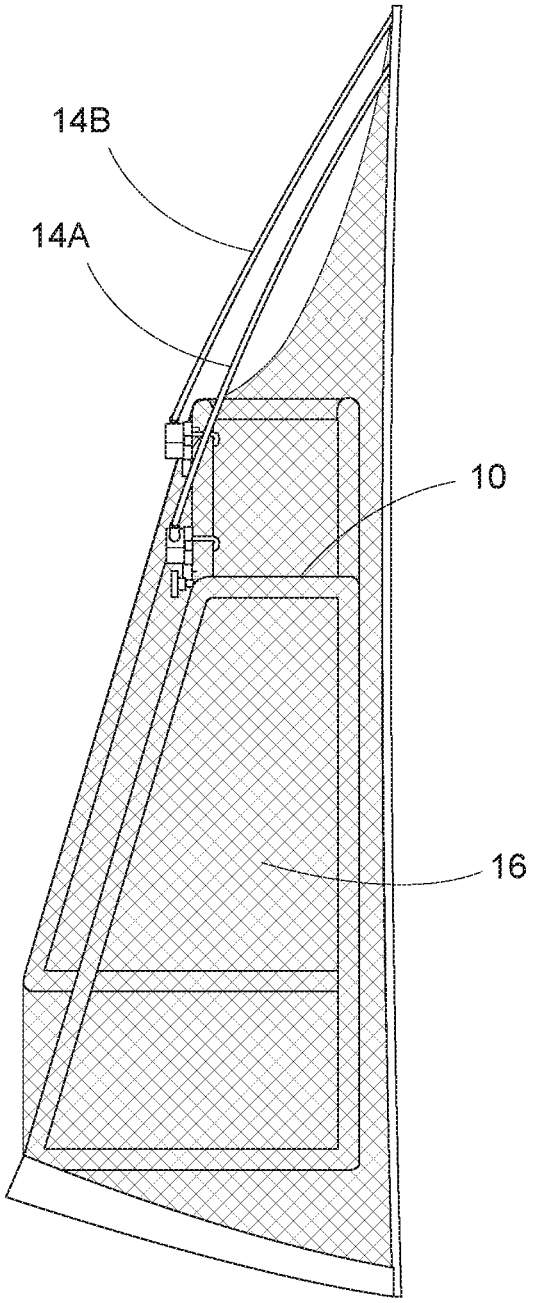
FIG. 2 illustrates the side view of the fully assembled backstop system with the attachable and adjustable bracket mechanism mounted on an existing hockey goal at its forward lean position with backstop netting.

FIG. 2 shows the side view of the fully assembled backstop system 12 at the forward lean position. The net poles 14*a* and 14*b* may pivot forward of the plain of the backstop netting 16 at an angle to provide improved and extended side coverage of the practice area.

Figure 3:
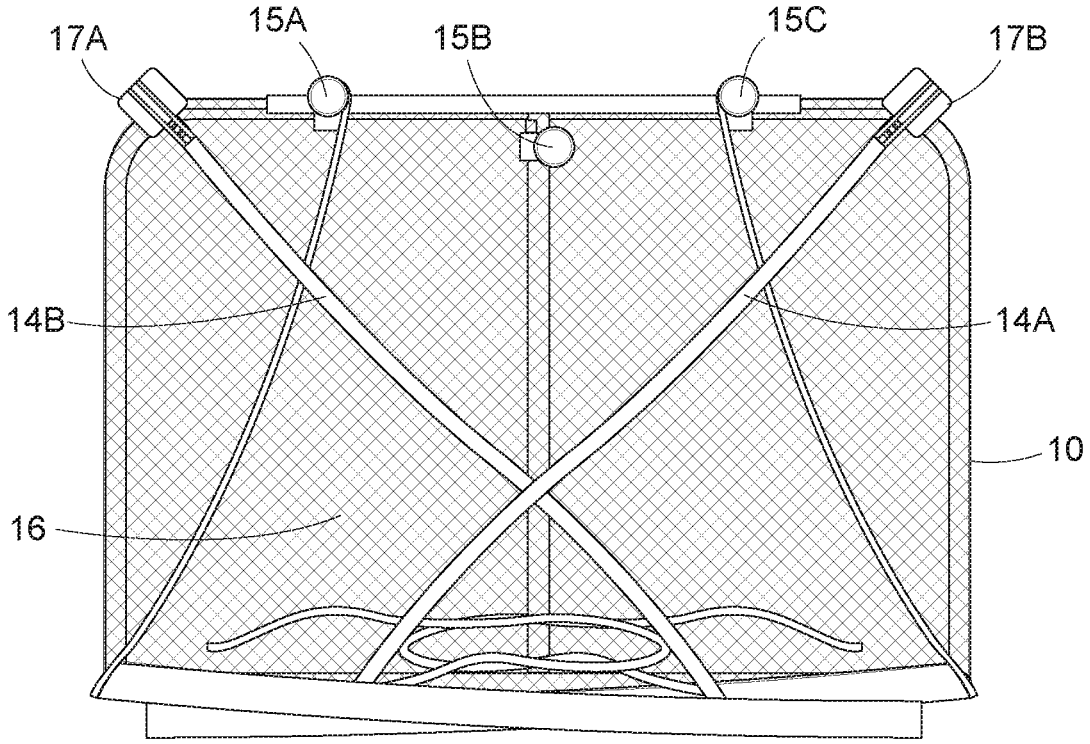
FIG. 3 illustrates the back view of the fully assembled backstop system with the attachable and adjustable bracket mechanism at its fold-away and bracket assembly in a collapsed position.

FIG. 3 shows the back view of the backstop system 12 at a fold-away and tube collapsed position when it is not in use, wherein the net poles 14*a* and 14*b* pivot behind the existing hockey goal 10 so that the backstop netting 16 is out of sight and does not obstruct normal play during a game. A user may lift to unlock the pivot bracket assembly 17*a* and 17*b* and rotate down the net poles 14*a* and 14*b* into the fold-away position behind the goal. To install and deploy the backstop netting 16 on the existing hockey goal 10, the user may simply attach the backstop system on the horizontal frame of the hockey goal 10 securely using bolt clamp apparatuses 15*a*, 15*b*, and 15*c*. In a preferred embodiment, the bolt clamp apparatuses 15*a*-15*c* are J-clamp bolts made from metal or heavy-duty plastic composites. The hockey goal 10 may also be transported on the field easily with the backstop system 12 securely mounted on it at its fold-away position.

Figure 4A:
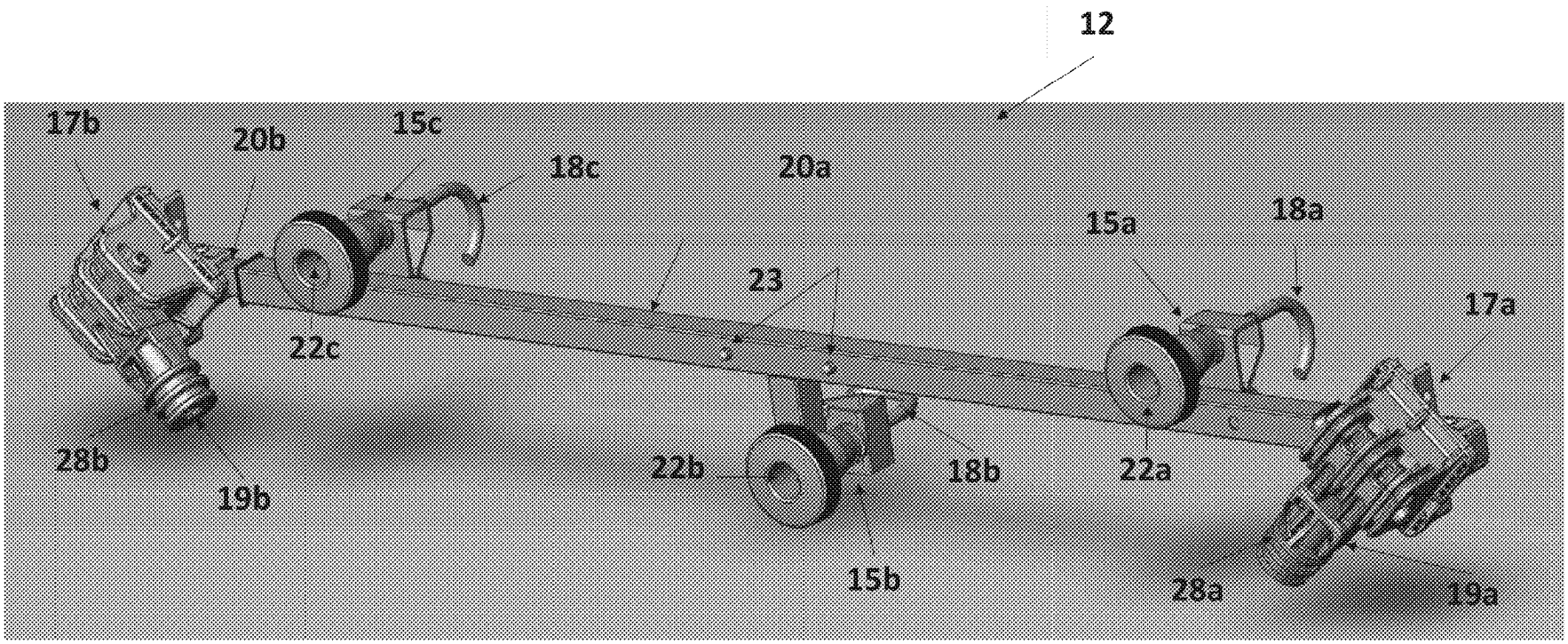
FIGS. 4*a*-4*b* are schematic diagrams showing the adjustable bracket frame, the tube assembly, the pivot bracket assembly, and the J-bolt clamps.
Figure 4B:
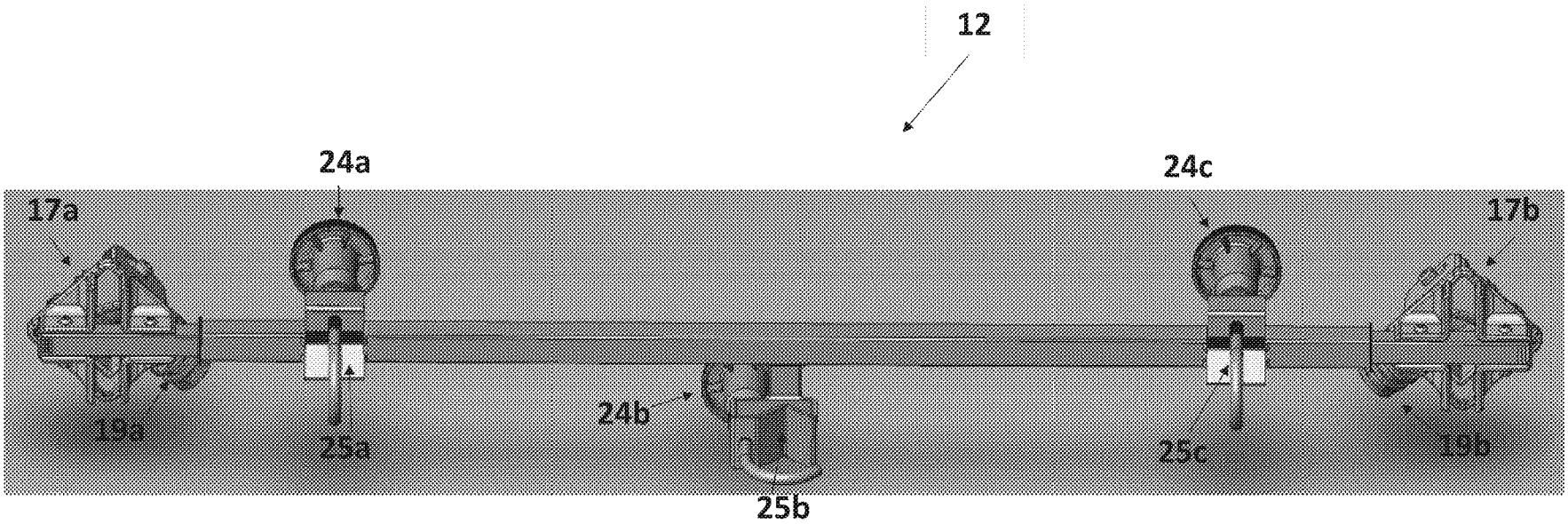

FIGS. 4*a*-4*b* illustrate the front and the back of the backstop system 12. In a preferred embodiment, the backstop system comprises an outer telescoping tube 20*a*, and an inner telescoping tube 20*b* to accommodate different sizes and widths of hockey goals; the first pivot bracket assembly 17*a* and the second pivot bracket assembly 17*b* to host a first net pole socket 19*a* and a second net pole socket 19*b* respectively, wherein the first and the second net pole sockets 19*a* and 19*b* may accommodate a pair of net poles; and a number of lock/unlock buttons 23 for length adjustability to fit all goal widths.

Additionally, the bolt clamp apparatuses 15*a*-15*c* further comprises J clamps 18*a*-18*c* and clamp knobs 22*a*-22*c*, wherein the clamp knobs 22*a*-22*c* may have large diameters in order to prevent catching or snagging in the backstop netting. In a preferred embodiment, net pole sockets 19*a* and 19*b* each comprises concentric rings 28*a* and 28*b* to improve strength of the net pole sockets 19*a* and 19*b* to help prevent breaking under pole lateral stress.

In one embodiment as shown in FIG. 4*b*, the clamp apparatuses comprise three-point, self-centering "V" brackets 25*a*-25*c* to accommodate all frame tube diameters and clamp knobs 24*a*-24*c* to prevent the backstop system from rotating during use.

Figure 5A:
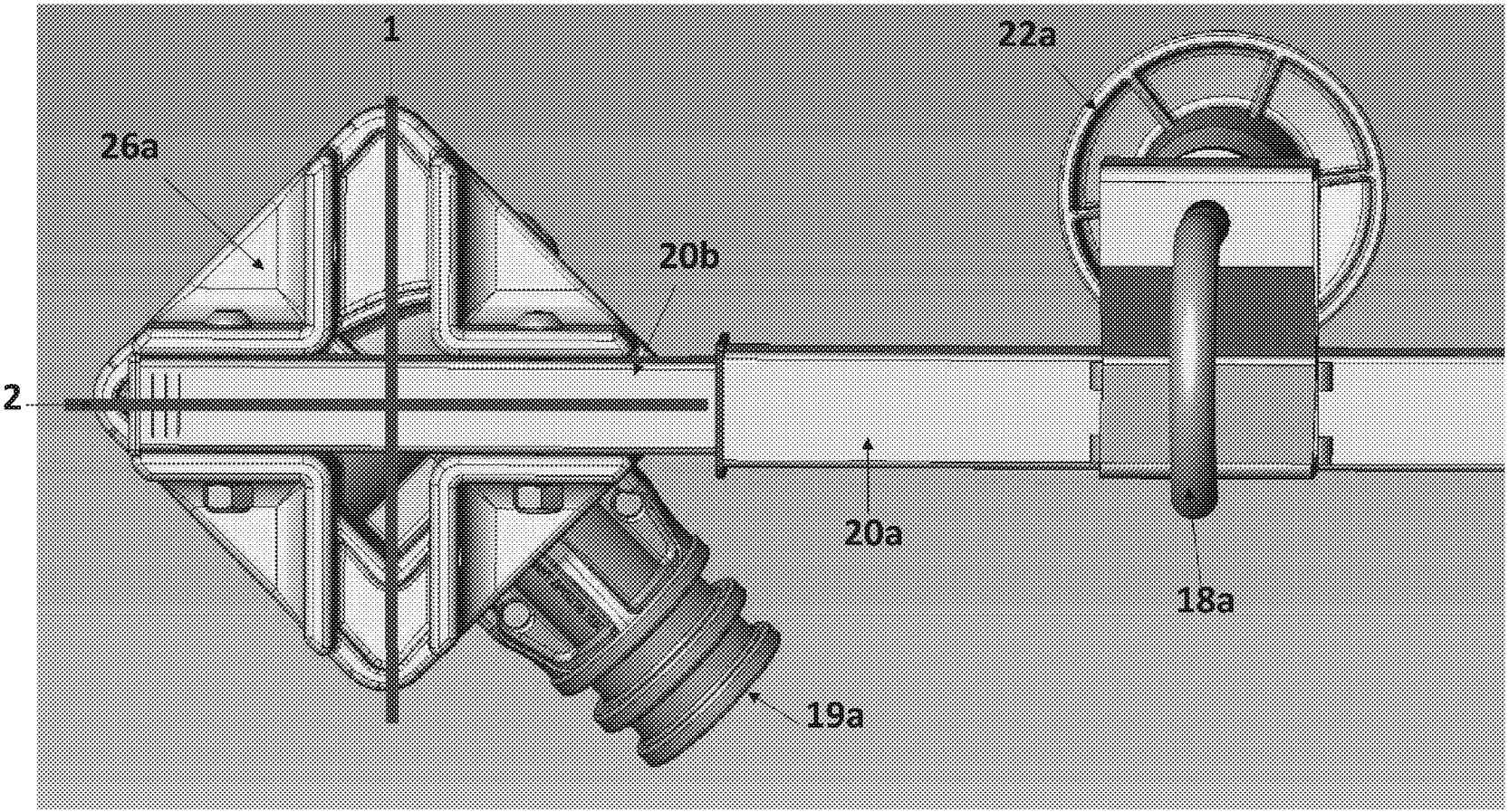
FIG. 5*a*-5*b* are schematic diagrams showing the back and the front views of the universal pivot bracket mounting base attached to one end of the adjustable bracket frame.

FIG. 5*a* shows the "X" geometry design of a pivot bracket mounting base 26*a* which comprises two channels 1 and 2. In a preferred embodiment, the "X" geometry design allows for the pivot bracket mounting base 26*a* to fit both the left and the right side of the backstop system via channel 1 or channel 2.

Figure 5B:
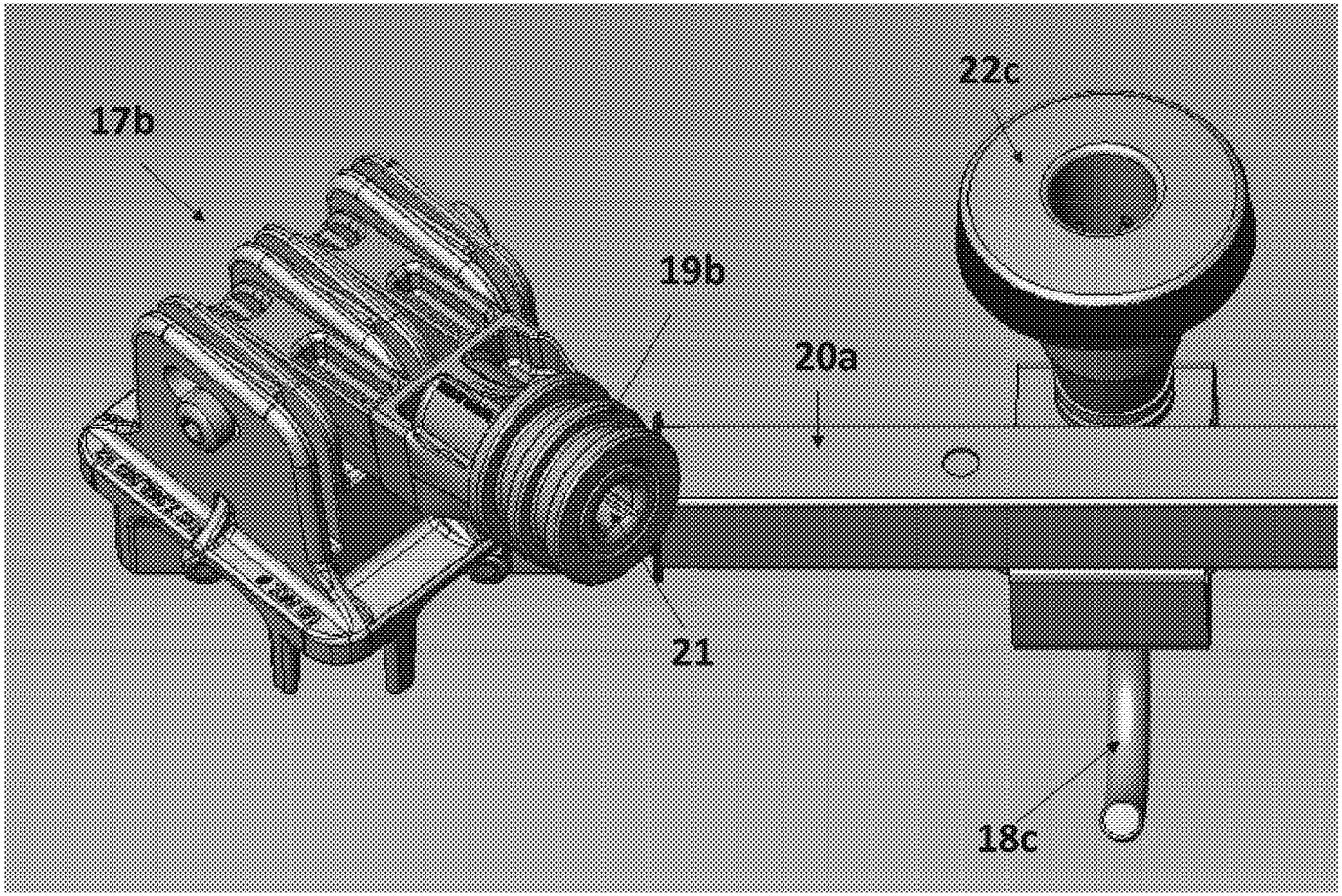

In one embodiment as shown in FIG. 5*b*, net pole socket 19*b* has a polymer insert 21 to ensure the net poles are impact resistance and allows for the net poles to be installed and removed without the utilization of tools. The polymer insert 21 is designed to absorb energy and insulate the net poles from the net pole socket 19*b* to minimize stress.

Figure 6:
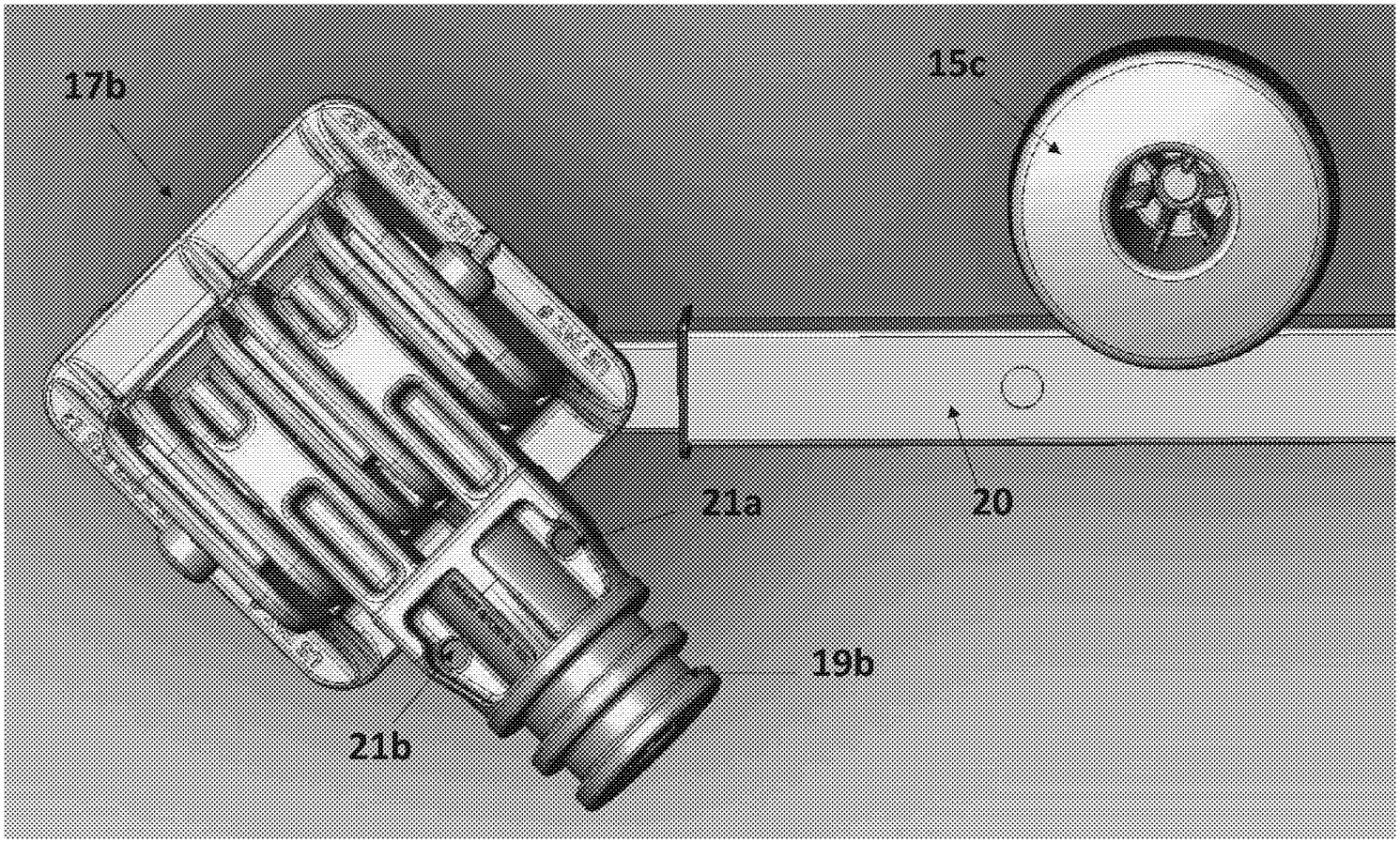
FIG. 6 is a schematic diagram showing the net retainer holes for the straps and the pivot bracket assembly in a stow away position.

FIG. 6. shows a pair of net retainer holes 21*a* and 21*b* located on either side behind the net pole socket 19*b* to receive straps that retain a net assembly to the pivot bracket assembly 17*b* in its fold-away position.

Figure 7:
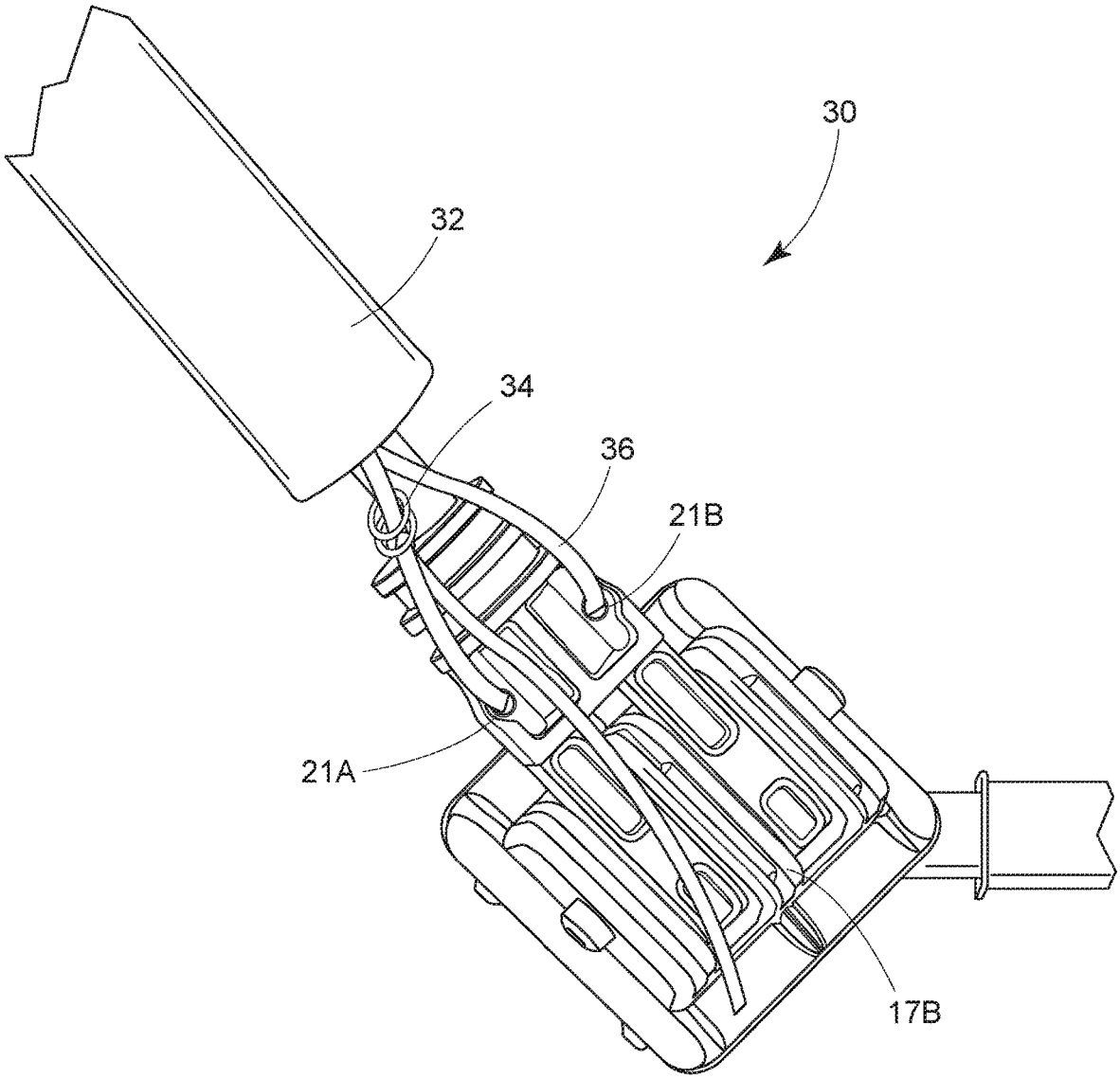
FIG. 7 illustrates the components of the net assembly.

Various components of one embodiment of a net assembly 30 are shown in FIG. 7, which comprises a net sleeve with strap 32, a plurality of "D" ring locks 34 for net retention, a pair of net retainer straps 36 strapped through the net retainer holes 21*a* and 21*b* of the pivot bracket assembly 17*b*, wherein a net pole may be placed inside the net sleeve with strap 32.

Figure 8:
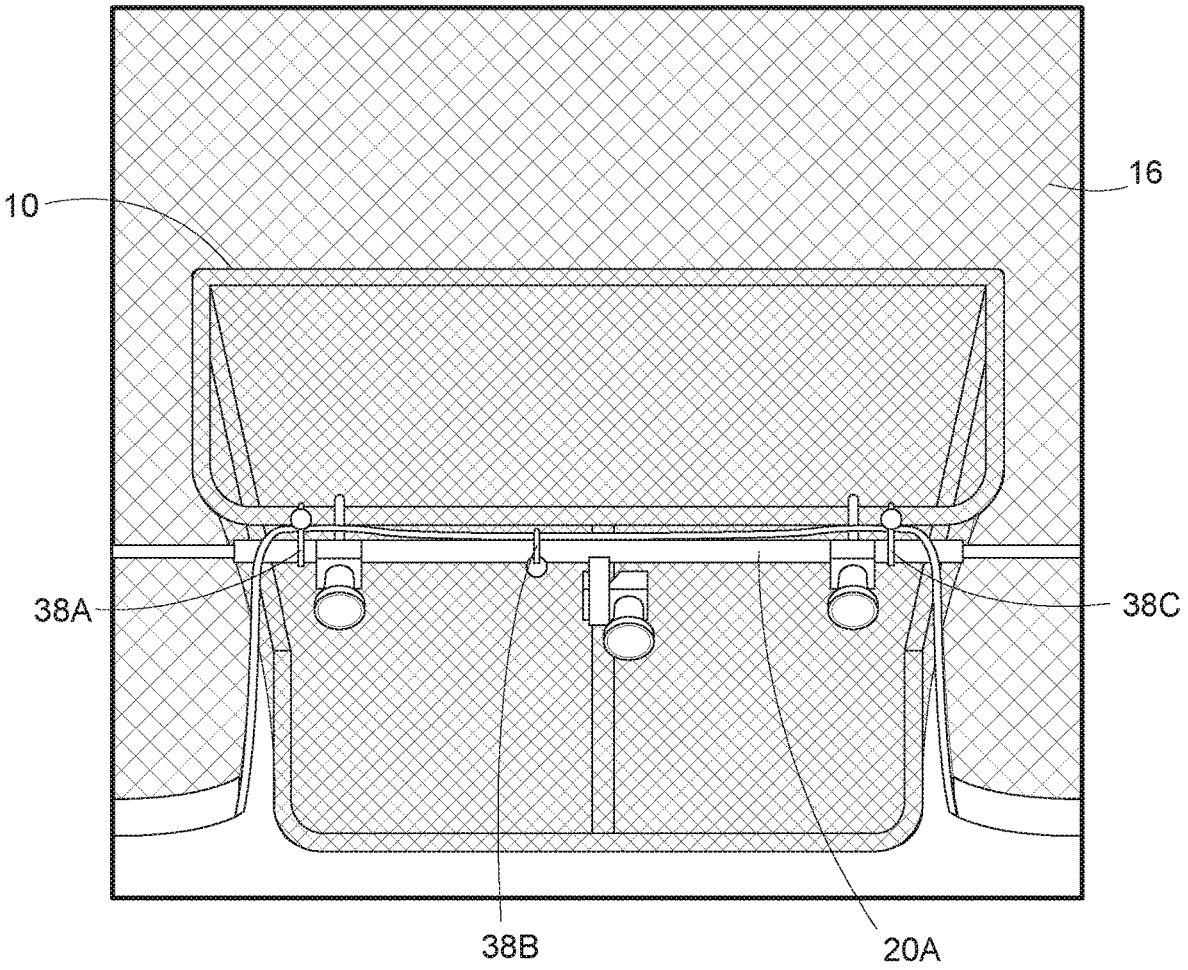
FIG. 8 illustrates three net edging ball bungee cord fastening positions on the back of an existing hockey goal.

FIG. 8 shows ball bungee cords 38*a* and 38*c* securely attach the bottom of the backstop netting 16 on the frame of the existing hockey goal 10, while ball bungee cord 38*b* attaches the bottom of the backstop netting 16 on the outer telescoping tube 20*a* of the backstop system so that the backstop netting 16 and the netting of the existing hockey goal 10 are integrated together securely and shooting gaps are minimized.

Figure 9:
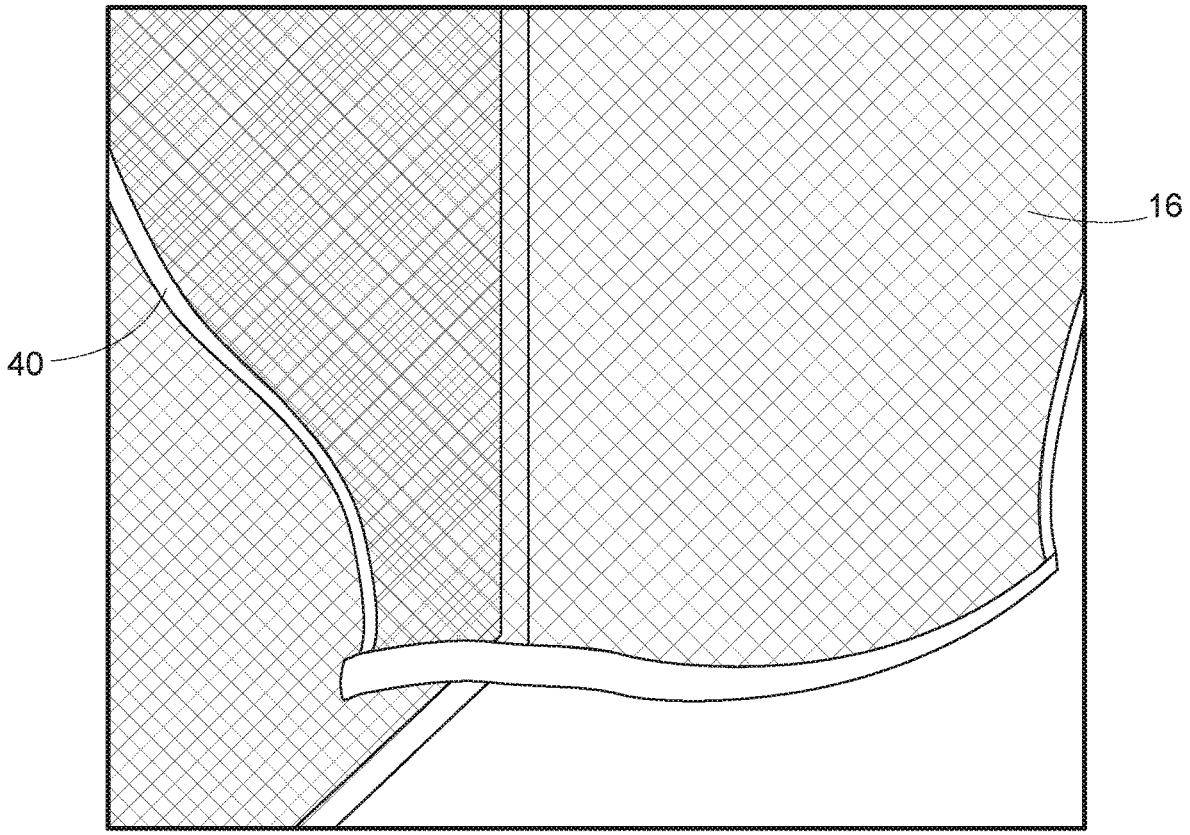
FIG. 9 illustrates two straps (one per side) for net-to-net attachment of net wings to goal net.

FIG. 9 shows an additional net-to-net attachment strap 40 on each side of the backstop netting 16 to prevent the netting from getting loose upon impact and/or during windy conditions. In a preferred embodiment, the net-to-net attachment strap 40 is 12 inches away from the bottom of the backstop netting 16.

What is claimed is:

1. A sports goal practice backstop system configured to removably attach to a sports goal comprising:

an adjustable bracket frame, removably mounted to the sports goal comprised of:

at least two bolt clamping mechanisms, each bolt clamping mechanism removably attached to the sports goal and positioned between a pair of pivot bracket assemblies, wherein each of the bolt clamping mechanisms comprises:

a clamp knob configured to prevent the sports goal practice backstop system from rotating during use, and a bracket configured to center the telescoping bracket frame;

wherein each pivot bracket assembly is positioned at an opposing end of the adjustable frame and each pivot bracket assembly further comprises:

a pivot bracket mounting base; and a net pole socket; and a first telescoping net pole and second telescoping net pole, wherein each net pole is received in a corresponding net pole socket on the pivot bracket assembly and a backstop netting is spread across the first and second telescoping net poles;

wherein the first and second telescoping net poles extend outwardly from each end of the adjustable frame.

2. The sports goal practice backstop system of claim 1, wherein the first and second telescoping net poles and the telescoping frame bracket each have a lock and unlock button configured to hold the first and second telescoping net poles and the telescoping frame bracket at a desired length.

3. The sports goal practice backstop system of claim 1, wherein the pivot bracket assembly further comprises the net pole socket having concentric rings and is configured to accommodate the insertion of the first and second telescoping net poles.

4. The sports goal practice backstop system of claim 1, wherein the net pole socket has a polymer insert configured to resist the impact of installation and removal of the first and second telescoping net poles.

5. The sports goal practice backstop system of claim 1, wherein the net pole socket has net retainer holes on the back side configured to receive straps attached to edges of the backstop netting.

6. The sports goal practice backstop system of claim 1, wherein the clamp knob includes a wide diameter configured to prevent catching and snagging on the backstop netting while holding the sports goal practice backstop in place.

7. The sports goal practice backstop system of claim 5, wherein the backstop system comprises a removably attached net backstop, wherein the removably attached net backstop comprises a net assembly on the ends of the net backstop which attaches to the pivot bracket assembly, the net assembly comprising:

a plurality of net sleeves with strap tails;

a plurality of d-ring locks configured to receive the strap tails and maintain net retention; and a plurality of net retainer straps configured to thread through the net retainer holes;

wherein the net retainer straps thread through the net retainer holes; and wherein the first and second telescoping net poles are placed within the net sleeves.

8. The sports goal practice backstop system of claim 1, wherein the backstop netting is held tight by a plurality of ball bungee cords, the plurality of ball bungee cords are configured to attach to the bottom of the backstop netting and the first and second telescoping net poles.

9. The sports goal practice backstop system of claim 1, wherein the backstop netting is held tight by a net-to-net attachment strap configured to strap to each side of the backstop netting and removably attaches to backstop netting.

* * * * *